US005455483A

United States Patent [19]

Azzi et al.

[11] Patent Number: 5,455,483

[45] Date of Patent: Oct. 3, 1995

[54] DEFLECTION YOKE WITH A PAIR OF MAGNETS NEAR ITS MINOR AXIS

[75] Inventors: Nacerdine Azzi, Genlis; Olivier Masson, Cuisery, both of France

[73] Assignee: Thomson Tubes & Displays, S.A., France

[21] Appl. No.: 197,911

[22] Filed: Feb. 17, 1994

[30] Foreign Application Priority Data

Feb. 18, 1993 [EP] European Pat. Off. ..... 93400432

[51] Int. Cl.[6] ..... H01F 1/00

[52] U.S. Cl. ..... 313/440; 313/431; 313/442; 335/210; 335/212

[58] Field of Search ..... 313/440, 412, 313/413, 428, 429, 430, 431, 442, 443; 335/210, 211, 212, 213

[56] References Cited

U.S. PATENT DOCUMENTS

| | | | |
|---|---|---|---|
| 4,143,345 | 3/1979 | Barkow | 335/212 |
| 4,433,268 | 2/1984 | Arisato | 313/440 |
| 4,939,415 | 7/1990 | Iwasaki et al. | 313/440 |
| 4,998,041 | 3/1991 | Hirosima | 313/440 |

FOREIGN PATENT DOCUMENTS

| | | | |
|---|---|---|---|
| 0519505 | 12/1992 | European Pat. Off. | H01J 29/70 |
| 0006357 | 1/1981 | Japan | 313/440 |
| 0307647 | 12/1988 | Japan | 313/440 |
| 1083947 | 7/1990 | Japan | 313/440 |
| 0204947 | 8/1990 | Japan | 313/440 |
| 4-370629 | 12/1992 | Japan | 313/440 |

*Primary Examiner*—Sandra L. O'Shea
*Assistant Examiner*—Vip Patel
*Attorney, Agent, or Firm*—Joseph S. Tripoli; Joseph J. Laks; Sammy S. Henig

[57] ABSTRACT

In a deflection yoke four Gorner magnets are used for correcting inner north-south raster distortion. The north-south axis of each of the corner magnets is disposed in parallel to the Z-axis.

7 Claims, 6 Drawing Sheets

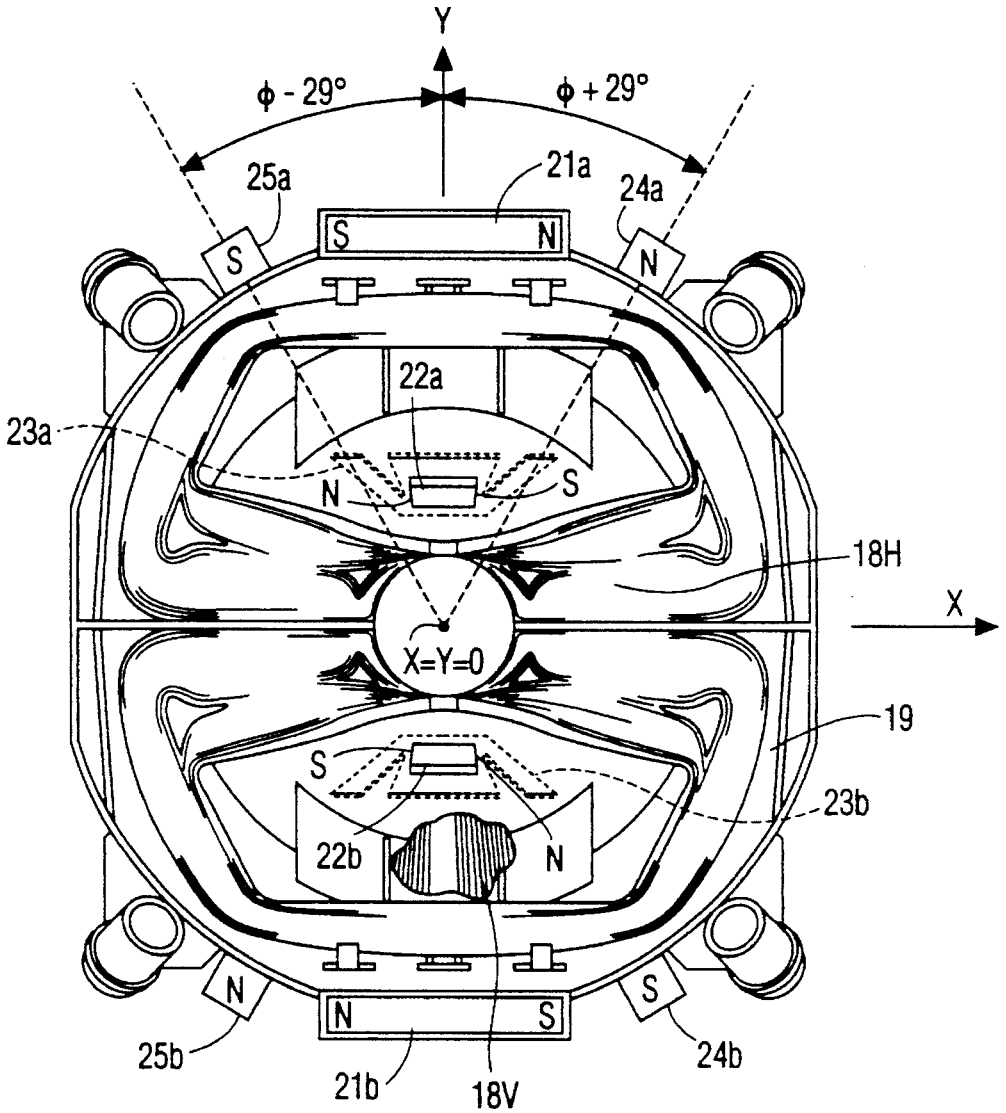
FIG. 2
FIG. 5
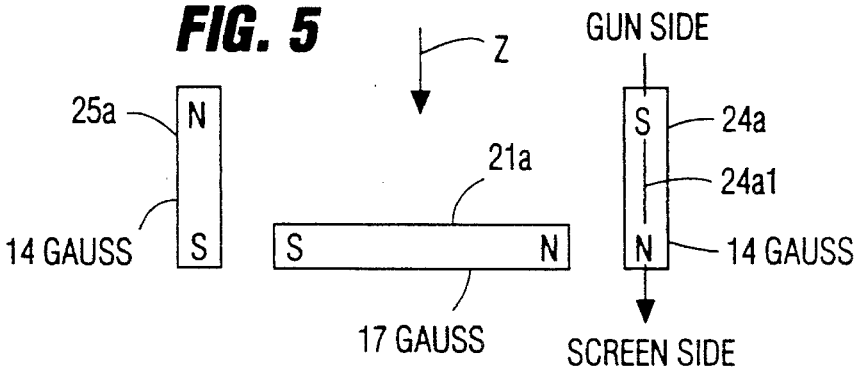

DEFLECTION YOKE WITH A PAIR OF MAGNETS NEAR ITS MINOR AXIS

The invention relates to a color picture tube (CRT) display system.

Due to the flatness of the CRT, a line displayed at the top or bottom of the screen of the CRT, that should ideally appear as a horizontal straight line, may exhibit a geometry distortion commonly referred to as outer pincushion North-South geometry distortion. Even a complete correction of outer pincushion geometry distortion, for example, by using conventional magnets at the top and bottom of the yoke may result in a residual inner barrel North-South geometry distortion. Inner barrel North-South geometry distortion occurs at a region of the CRT screen, midway between the top and center of the CRT screen, or midway between the bottom and center of the CRT screen. It may be desirable to correct such inner North-South geometry distortion such that overall North-South geometry distortion is reduced. Additionally, due to the flatness of the CRT, a geometry distortion commonly referred to as gullwing distortion may appear in horizontal lines displayed on the screen of the CRT. It may also be desirable to correct such gullwing distortion. Therefore, four corner magnets, embodying an inventive feature, are disposed in the vicinity of the electron beam exit portion of the deflection yoke. The comer magnets are disposed in a symmetrical manner at four quadrants, respectively, of a plane perpendicular to the Z-axis of the CRT. The field produced by the corner magnets corrects the aforementioned geometry distortions.

A deflection apparatus, embodying an aspect of the invention, includes a cathode ray tube of an in-line system including an evacuated glass envelope. A display screen is disposed at one end of the envelope. An electron gun assembly is disposed at a second end of the envelope. The electron gun assembly produces a plurality of electron beams that form corresponding rasters on the screen upon deflection. A deflection yoke is mounted around the envelope and includes a vertical deflection coil for producing a vertical deflection field in the cathode ray tube. The deflection yoke further includes a horizontal deflection coil for producing a horizontal deflection field in the cathode ray tube. A core made of magnetically permeable material magnetically is coupled to the vertical and horizontal deflection coils. A corner magnet having a north-south axis that is generally parallel with a Z-axis of the yoke is disposed near a beam exit section closer to a Y-axis than to an X-axis of the yoke.

FIG. 2 illustrates a front view of the deflection yoke of FIG. 1 as seen from the display screen of the cathode ray tube;

FIG. 5 illustrates a top view of comer magnets embodying an inventive feature of the yoke of FIG. 1; and FIGS. *6a–6d* illustrate harmonic potential distribution functions for the yoke of FIG. 1.

Figure 1:
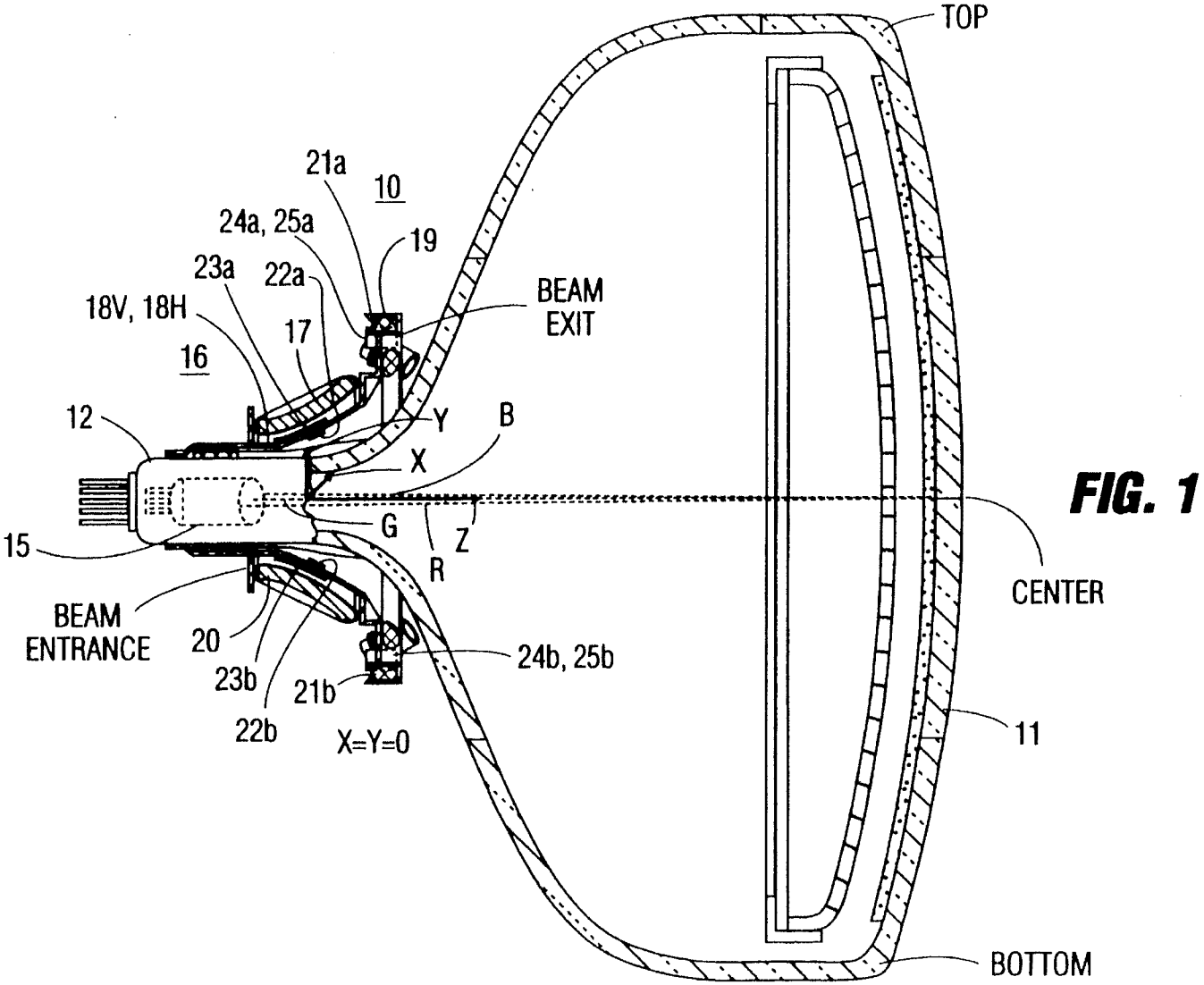
FIG. 1 illustrates a side view of a deflection yoke embodying an aspect of the invention that is mounted on a cathode ray tube.

In FIG. 1, a CRT 10 includes a screen or faceplate 11 upon which are deposited repeating groups of red, green and blue phosphor trios. CRT 10 is of the type A68EET38X110 with a Super-Flat faceplate size 27V or 68 centimeter. The deflection angle is 108°. The distance from the yoke reference line to the inside of the screen at the screen center, referred to as the throw distance, is 275 millimeter. Faceplate 11 is much flatter than typical CRT's and sagittal heights are only half that of typical face contour.

The contour of the inner surface of the faceplate 11 is defined by the following equation.

$$Z_c = A1 \cdot X^2 + A2 \cdot X^4 + A3 \cdot X^6 + A4 \cdot Y^2 + A5 \cdot X^2 \cdot Y^2 + A6 \cdot X^4 + Y^2 + A7 \cdot X^6 \cdot Y^2 + A8 \cdot Y^4 + A9 \cdot X^2 \cdot Y^4 + A10 \cdot X^4 \cdot Y^4 + A11 \cdot X^6 \cdot Y^4 + A12 \cdot Y^6 + A13 \cdot X^2 \cdot Y^6 + A14 \cdot X^4 \cdot Y^6 + A15 \cdot X^6 \cdot Y^6$$

where $Z_c$ is the distance from a plane tangent to the center of the inner surface contour.

X and Y represent distances from the center, in the directions of the major and minor axes, respectively.

A1 to A15 are coefficients that depend on the diagonal dimension of the faceplate.

For a tube faceplate of CRT 10 with a viewing screen having a diagonal dimension of 68 cm, suitable coefficients A1 to A15 are shown in Table I. A CRT with the contour defined by these coefficients may benefit in convergence characteristics when using inventive features described below. The X and Y dimensions must be in millimeters to use the coefficients of the Table.

TABLE

| |
|---|
| $A1 = 0.2380978 \times 10^{-03}$ |
| $A2 = 0.1221162 \times 10^{-09}$ |
| $A3 = 0.9464281 \times 10^{-14}$ |
| $A4 = 0.3996533 \times 10^{-03}$ |
| $A5 = -.3144822 \times 10^{-08}$ |
| $A6 = -.2969186 \times 10^{-14}$ |
| $A7 = 0.0000000 \times 10^{+00}$ |
| $A8 = 0.6663320 \times 10^{-09}$ |
| $A9 = 0.2935719 \times 10^{-14}$ |
| $A10 = -.3869349 \times 10^{-18}$ |
| $A11 = 0.0000000 \times 10^{+00}$ |
| $A12 = 0.1755161 \times 10^{-13}$ |
| $A13 = 0.9320407 \times 10^{-19}$ |
| $A14 = 0.7687528 \times 10^{-25}$ |
| $A15 = 0.2308889 \times 10^{-28}$ |

An electron gun assembly 15 is mounted in a neck portion 12 of the tube opposite the faceplate. Gun assembly 15 produces three horizontal in-line beams R, G and B. A deflection yoke assembly designated generally as 16 is mounted around the neck and flared portion of the tube by a suitable yoke mount or plastic liner 19. Yoke 16 also includes a flared ferrite core 17, a vertical deflection coil 18V and a horizontal deflection coil 18H. Deflection yoke 16 is of the self-convergence type.

FIG. 2 illustrates in greater detail deflection yoke 16, embodying an aspect of the invention. Similar symbols and numerals in FIGS. 1 and 2 indicate similar items or functions. In FIG. 2 the yoke assembly is viewed from the electron-beam exit side. Plastic plastic liner 19 of FIG. 2 serves to hold pair of saddle-type horizontal deflection coils 18H in proper orientation relative to flared ferrite core 17 around which vertical deflection winding 18V is wound. Thus, deflection yoke 16 is a saddle-toroid (ST) type. In the side view illustrated in FIG. 3, a beam-exit end is on the right. Similar symbols and numerals in FIGS. 1, 2 and 3 indicate similar items or functions.

A longitudinal or Z-axis of yoke 16 or CRT 10 of FIG. 1 is defined in a conventional manner. In each plane of yoke 16 defined by a corresponding coordinate Z that is perpendicular to the Z-axis, a corresponding Y-axis is defined in parallel to a vertical or minor axis of screen 11. Similarly, a corresponding X-axis is defined in parallel to a horizontal or major axis of screen 11. The coordinate X=Y=O in each plane of yoke 16 is located on the Z-axis.

In the vicinity of a beam entrance end of yoke 16 of, for example, FIG. 1, a vertical deflection field produced by coil 18V is preferably pincushioned-shaped for correcting vertical coma error. To reduce over-convergence at the 6 and 12 o'clock hour points, the vertical deflection field produced by vertical deflection coil 18V is made barrel-shaped at an intermediate portion of the yoke, between the beam entrance and exit ends of yoke 16 of FIG. 1.

It may be desirable to enhance the degree of barrel-shaped field nonuniformity over what can be obtained by arrangement of the winding distribution of the vertical deflection coil. Accordingly, a pair of field formers or shunts 23*a* and 23*b* made of soft or permeable material are mounted near the top and bottom of the yoke in the intermediate portion of the yoke. Advantageously, field formers 23*a* and 23*b* increase the barrel-shaped field nonuniformity and are mounted on the side of plastic yoke mount or insulator 19 that faces vertical deflection winding 18V between vertical deflection winding 18V and the neck of CRT 10.

Figure 3:
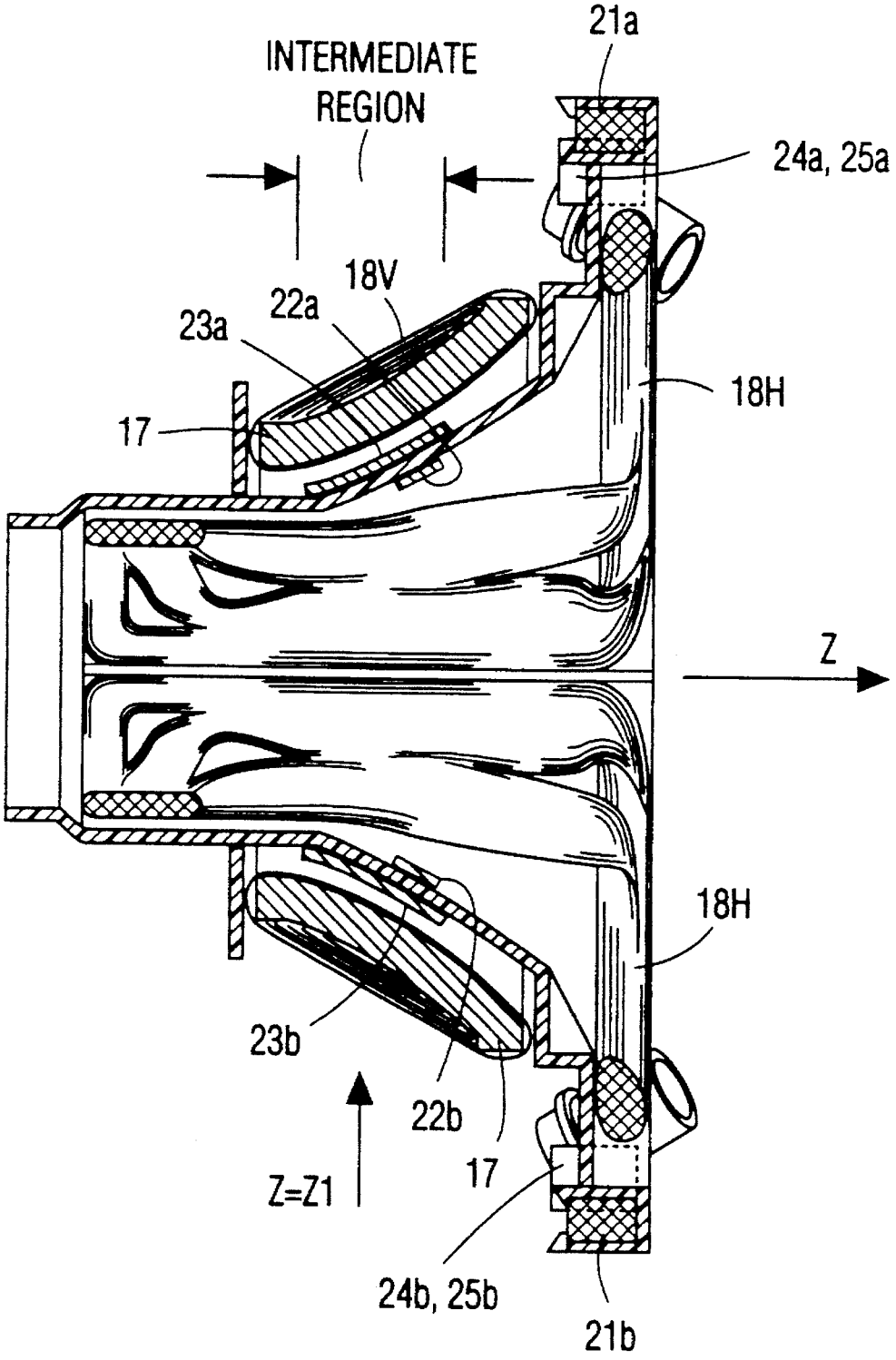
FIG. 3 illustrates a side view of the yoke of FIG. 1 in more detail.
Figure 4:
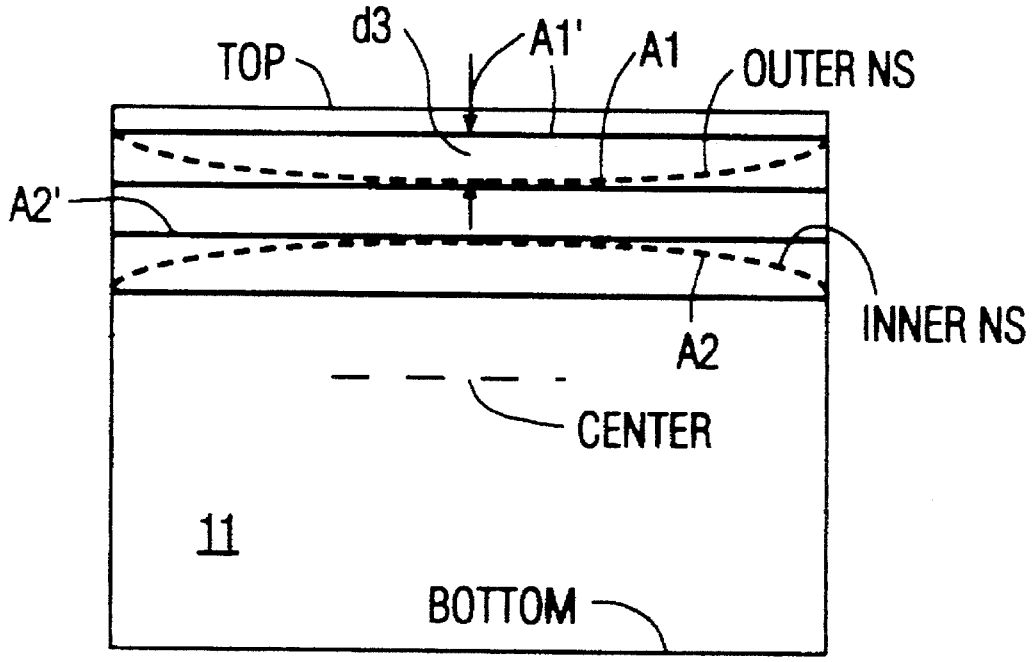
FIG. 4 illustrates, a corresponding display pattern on a screen of a cathode ray tube for explaining corresponding beam landing errors.

FIG. 4 illustrates in broken line a curved horizontal line A1 of a display pattern at, for example, the top of screen 1 1 of CRT 10. Similar symbols and numerals in FIGS. 1–4 indicate similar items or functions. Line A1 of FIG. 4 is curved when external N-S raster distortion is uncorrected. External N-S raster distortion is measured by the distance d3 in FIG. 4, representing the maximum deviation between line A1 and an ideal straight horizontal line A1'. To correct such N-S raster distortion, a pair of magnets 21*a* and 21*b* of FIGS. 2 and 3 are mounted near the top and bottom, respectively, of the yoke at the front or beam-exit portion of the yoke. Magnets 21*a* and 21*b* are affixed in recesses in mount 19 and are poled as indicated. Magnets 21*a* and 21*b* of FIG. 2 that are disposed near the beam exit end of the yoke are used to correct external North-South (top-bottom) pincushion distortion. The magnetic field produced by magnet 21*a*, for example, provides the greatest deflection force near the center at the top of the raster and least near the sides of the raster. Thus, the magnetic field of magnet 21*a* is suited for correcting external N-S pincushion distortion. As a result of the correction, line A1 of FIG. 4 may approach the ideal straight horizontal line A1' shown as a solid line on screen 11. Magnet 21*b* of FIGS. 2 and 3 performs similar function when the line is displayed at the bottom of the screen.

Magnets 21*a* and 21*b* may degrade the barreling of the vertical deflection field necessary to provide proper convergence. To restore in part the barreling of the vertical deflection field, a pair of magnets 22*a* and 22*b* is disposed adjacent the flared inner surface of the yoke at the top and bottom closer towards the beam-entrance end of the yoke. Magnets 22*a* and 22*b* are mounted to conform to the contour of coil 18H and disposed between coil 18H and the neck of CRT 10. Magnets 22*a* and 22*b* as well as shunts 23*a* and 23*b* compensate for the convergence error that might be otherwise introduced by magnets 21*a* and 21*b*, respectively. The convergence error compensation is obtained because of the resulting increase of the barreling of the vertical deflection field in a region of the deflection field that is further away along the Z-axis from the screen of CRT 10 than magnets 21*a* and 21*b*.

Assume that correction of external or outer N-S geometry distortion is accomplished by magnets 21*a* and 21*b*. As a result of the flatness of screen 11 of CRT 10, a line A2 of FIG. 4 of a display pattern shown in broken lines that is ideally a straight horizontal line could exhibit a barrel-shaped geometry distortion. Line A2 is displayed in the middle between the vertical center and top line A1 or A1' of FIG. 4. Such geometrical distortion is referred to as internal or inner N-S geometry distortion and is measured in a similar way to that of external N-S geometry distortion. To correct such internal N-S geometry distortion, it may be desirable to apply a greater deflection force in the vertical direction in the vicinity of the sides of the raster than at the center of the raster with respect to line A2.

Therefore, a pair of permanent corner magnets 24*a* and 25*a* of FIG. 2, embodying an inventive feature, are mounted on liner 19 at opposite sides of top magnet 21*a*. Magnet 24a is disposed approximately at angle Ø=+29° and magnet 25*a* is disposed approximately at angle Ø=−29° and symmetrically with respect to the corresponding Y-axis. Thus, each of magnets 24*a* and 25*a* is disposed closer to the Y-axis than to the X-axis because angle Ø is smaller than 45°.

The usage of corner magnets 24*a* and 25*a* permits the usage of North-South magnet 21*a* that is weaker than required without the corner magnets. Advantageously, by employing magnet 21*a* that is weaker, the above mentioned barrel-shaped inner North-South geometry distortion is reduced. Thus, the combination of corner magnets 24*a* and 25*a* with North-South magnet 21*a* provides both inner/outer North-South geometry distortion correction.

A pair of comer magnets 24*b* and 25*b* of FIG. 2 are disposed symmetrically to magnets 24*a* and 25*a*, respectively, with respect to the X-axis. Comer magnets 24*b* and 25*b* are disposed at opposite sides of magnet 21*b*. Magnets 24*a*, 21*a* and 25*a* affect beam spot landing position mainly when the beam spot is above the vertical center of the screen of the CRT. In a similar manner, magnets 24*b*, 21*b* and 25*b* affect it mainly when the beam spot is below the vertical center. FIG. 5 illustrates a top view of magnets 21*a*, 24*a* and 25*a*. Similar symbols and numerals in FIGS. 1–5 indicate similar items or functions.

In carrying out an inventive feature, a north-south axis of each of magnets 24*a*, 25*a*, 24*b* and 25*b* of FIG. 2 is at an angle that is smaller than 45° with respect to the Z-axis. Thus, such north-south axis comes closer to be in parallel with the Z-axis than to be perpendicular to the Z-axis. In the example of FIG. 2, such north-south axis is disposed generally in parallel with the Z-axis. In comparison, the north-south axis of magnet 21*a* is perpendicular to the Z-axis. Thus, a north-south axis 24*a*1 of comer magnet 24*a* is parallel with the Z-axis in FIG. 5. Orienting the north-south axis of each of magnets 24*a*, 25*a*, 24*b* and 25*b* of FIG. 2 in parallel with the Z-axis is advantageous in that overall N-S geometry distortion and also gullwing distortion are reduced relative to a situation in which the north-south axis of each comer magnet is perpendicular to the Z-axis. For example, when the north-south axis of each of corner magnets 24*a*, 25*a*, 24*b* and 25*b* of FIG. 2 is in parallel with the Z-axis, external North-South geometry distortion was measured to be −0.15 percent, and internal North-South geometry distortion was measured to be −0.5 percent. When, for comparison, the north-south axis of each comer magnet was perpendicular to the Z-axis, the results were +1.9 percent and +0.2 percent, respectively. Thus, overall or average external/internal N-S distortion is reduced when the corner magnets are oriented in the manner shown in FIG. 2.

Moreover, the degree of gullwing distortion correction is also improved relative to the hypothetical situation in which the north-south axis of each of such corner magnets is perpendicular to the Z-axis. Thus, when the orientation of the north-south axis of magnets 24*a*, 25*a*, 24*b* and 25*b* is as shown in FIG. 2, maximum external gullwing distortion for example at 1:30 o'clock hour point was measured to be +0.16 percent and maximum inner gullwing distortion at the same horizontal coordinate, referred to as 2A:30 o'clock hour point was measured to be +0.13 percent; whereas, at the same point on the screen, when the north-south axis is perpendicular with the Z-axis, maximum external/internal gullwing distortion was measured to be −0.3 and +0.16 percent, respectively. Having the same sign for the magnitude of each of the outer and inner gullwing distortions provides a less objectionable image than when the signs are opposite. Such advantage is particularly manifested for picture-in-picture applications.

Figure 6A:
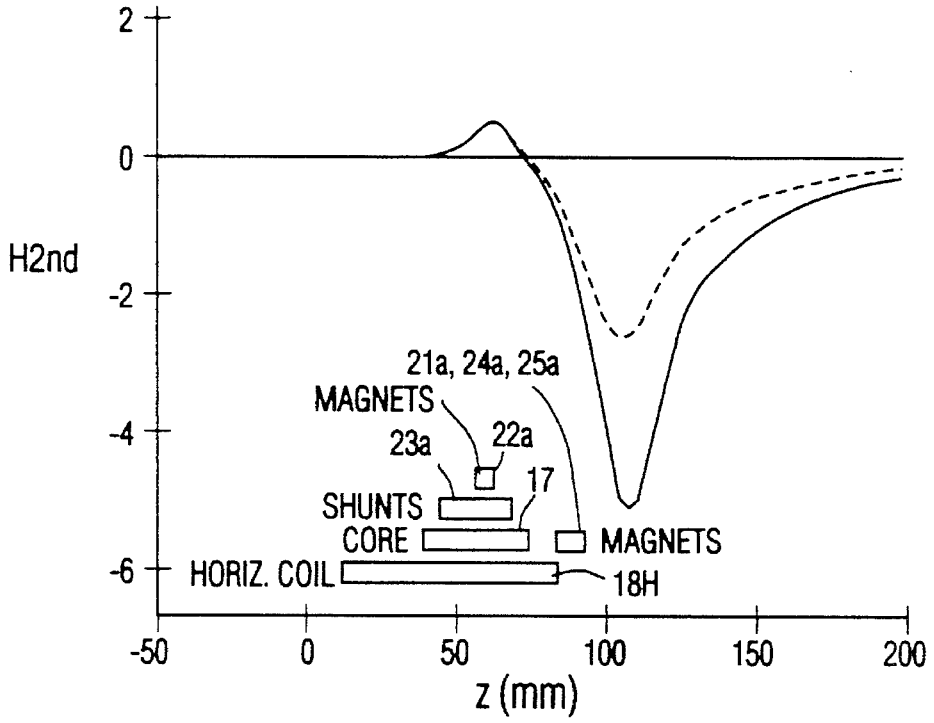
Figure 6B:
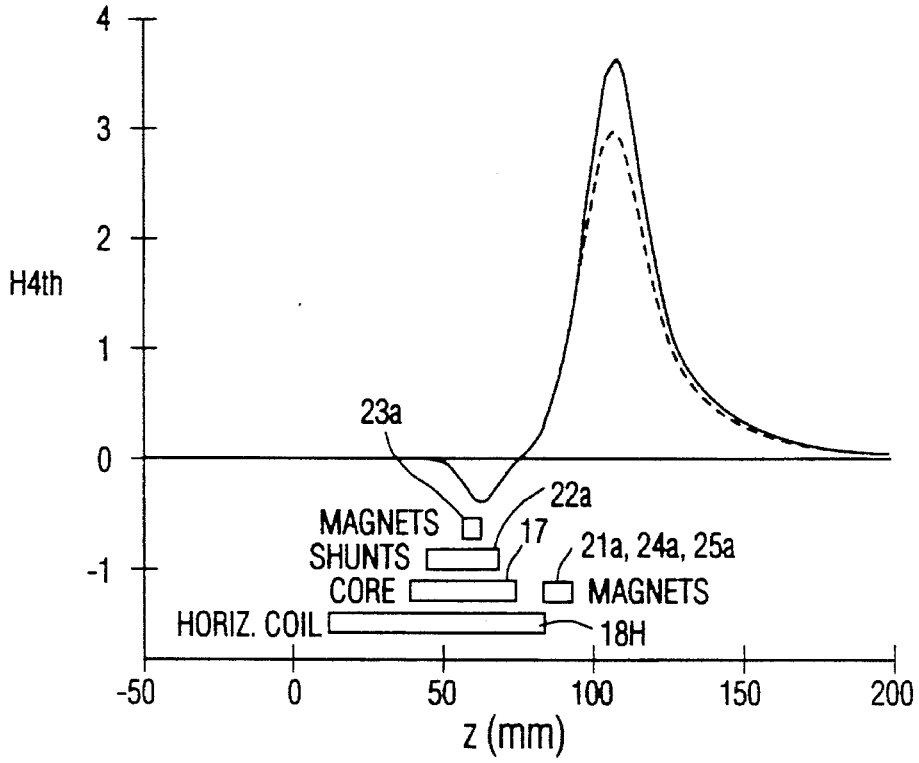
Figure 6C:
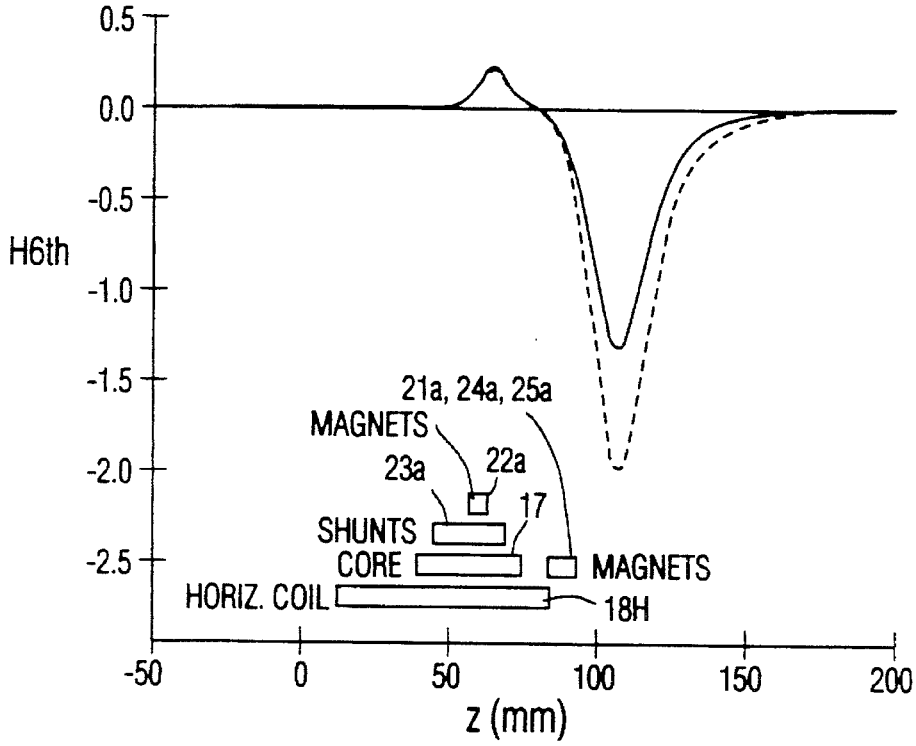
Figure 6D:
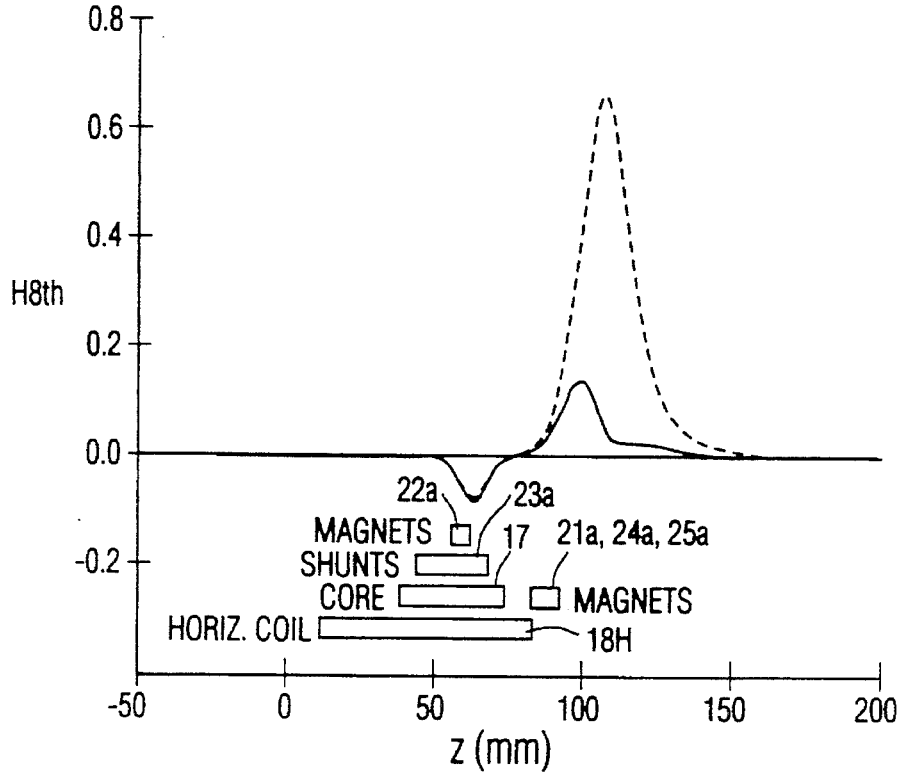

FIGS. 6*a*, 6*b*, 6*c* and 6*d* show in solid lines 2nd, 4th, 6th and 8th harmonic potential distribution functions of the horizontal field, respectively, of the arrangement of FIG. 1. Similar symbols and numerals in FIGS. 1–5 and 6*a*–6*d* indicate similar items or functions. For comparison purposes only, in each of FIG. 1, the corresponding harmonic potential function is shown in broken line for a situation in which the north-south axis of each of comer magnets 24*a*, 25*a*, 24*b* and 25*b* of FIG. 2 is directed perpendicularly to the Z-axis. By orienting the north-south axis of each of comer magnets 24*a*, 25*a*, 24*b* and 25*b* of FIG. 2 in parallel to the Z-axis, the magnitude of each of the 2nd and 4th harmonic potential values increases, as shown in FIGS. 6*a* and 6*b*; whereas, the magnitude of each of the 6th and 8th harmonic potential value is decreased, as shown in FIGS. 6*c* and 6*d*.

What is claimed is:

1. A video display apparatus, comprising:

a cathode ray tube of an in-line system including an evacuated glass envelope, a display screen disposed at one end of said envelope, an electron gun assembly disposed at a second end of said envelope, said electron gun assembly producing a plurality of electron beams that form corresponding rasters on said screen upon deflection;

a deflection yoke mounted around said envelope, including:

a vertical deflection coil for producing a vertical deflection field in said cathode ray tube;

a horizontal deflection coil for producing a horizontal deflection field in said cathode ray tube;

a core made of magnetically permeable material magnetically coupled to said vertical and horizontal deflection coils; and first, second, third and fourth corner magnets that are disposed in a symmetrical manner at four quadrants, respectively, of a plane perpendicular to a Z-axis, each of said comer magnets having a north-south axis that is generally parallel with a Z-axis of said yoke and disposed near a beam exit section closer to a Y-axis than to an X-axis of said yoke.

2. A video display apparatus, comprising:

a cathode ray tube of an in-line system including an evacuated glass envelope, a display screen disposed at one end of said envelope, an electron gun assembly disposed at a second end of said envelope, said electron gun assembly producing a plurality of electron beams that form corresponding rasters on said screen upon deflection;

a deflection yoke mounted around said envelope, including:

a vertical deflection coil for producing a vertical deflection field in said cathode ray tube;

a horizontal deflection coil for producing a horizontal deflection field in said cathode ray tube;

a core made of magnetically permeable material magnetically coupled to said vertical and horizontal deflection coils; and a corner magnet having a north-south axis that comes closer to be in parallel with a Z-axis than to be perpendicular to said Z-axis of said yoke and disposed near a beam exit section closer to a Y-axis than to an X-axis of said yoke.

3. An apparatus according to claim 2, wherein said north-south axis is generally parallel with said Z-axis.

4. An apparatus according to claim 3 further comprising, a second corner magnet having a north-south axis that is generally parallel with said Z-axis and disposed symmetrically to said first permanent magnet with respect to said Y-axis and a third magnet disposed in a vicinity of said Y-axis near said beam exit end of said yoke between said first and second corner magnets and having a north-south axis that is perpendicular to said Z-axis for correcting both outer north-south geometry distortion and inner north-south geometry distortion.

5. An apparatus according to claim 4, wherein each of said corner magnets comprises a permanent magnet.

6. An apparatus according to claim 5 wherein a front end of each of said first, second and third magnets is disposed in the same X–Y plane of said yoke.

7. An apparatus according to claim 4 wherein said third magnet corrects for outer North-South geometry distortion and wherein said corner magnets correct more inner North-South geometry distortion than said third magnet.

* * * * *